US008646621B2

(12) United States Patent
Zacherle et al.

(10) Patent No.: US 8,646,621 B2
(45) Date of Patent: Feb. 11, 2014

(54) PRODUCT BIASING AND DISPENSING SYSTEM WITH SECURITY ENGAGEMENT

(75) Inventors: Matthew E. Zacherle, Richmond, VA (US); Laurel Thomas, Richmond, VA (US); Bradford J. Walling, Chesterfield, VA (US)

(73) Assignee: MeadWestvaco Corporation, Richmond, VA (US)

( * ) Notice: Subject to any disclaimer, the term of this patent is extended or adjusted under 35 U.S.C. 154(b) by 236 days.

(21) Appl. No.: 13/049,004

(22) Filed: Mar. 16, 2011

(65) Prior Publication Data

US 2012/0234851 A1 Sep. 20, 2012

(51) Int. Cl.

| | |
|---|---|
| ***A47F 5/08*** | (2006.01) |
| ***B42F 17/02*** | (2006.01) |
| ***B65H 1/08*** | (2006.01) |
| ***G07F 11/16*** | (2006.01) |

(52) U.S. Cl.

USPC ..... 211/59.3; 211/51; 221/279; 221/197; 221/1; 221/198; 221/100; 206/774; 206/526; 206/817; 206/556

(58) Field of Classification Search

CPC ..... A47F 5/08; B42F 17/02; B65H 1/08; G07F 11/16

USPC ..... 221/279, 59.3, 197, 198, 100, 1; 211/59.3, 119.005, 51; 206/774, 526, 206/817, 556

See application file for complete search history.

(56) References Cited

U.S. PATENT DOCUMENTS

| | | | | |
|---|---|---|---|---|
| 1,691,743 | A | | 11/1928 | Ulrich |
| 2,060,146 | A | | 11/1936 | Venderveer |
| 2,472,567 | A | | 6/1949 | Bruen |
| 2,853,078 | A | | 9/1958 | Nabholz |
| 3,055,293 | A | | 9/1962 | Lariccia |
| 3,161,295 | A | * | 12/1964 | Chesley ..... 211/59.3 |
| 3,203,554 | A | | 8/1965 | Pendergrast et al. |
| 3,224,822 | A | | 12/1965 | Kirby |
| 3,308,961 | A | | 3/1967 | Chesley |
| 3,342,536 | A | * | 9/1967 | Cohen ..... 312/71 |
| 3,452,983 | A | | 7/1969 | Wood |
| 3,664,545 | A | | 5/1972 | Beesley |
| 3,923,159 | A | | 12/1975 | Taylor et al. |

(Continued)

FOREIGN PATENT DOCUMENTS

| | | |
|---|---|---|
| DE | 29808673 | 11/1998 |
| DE | 19808162 | 9/1999 |

(Continued)

OTHER PUBLICATIONS

"Shelf Management System" by Index Plastics Limited (www.indexplastics.co.uk/shelf-management) (Mar. 11, 2011).

(Continued)

*Primary Examiner* — Gene O. Crawford
*Assistant Examiner* — Rakesh Kumar
(74) *Attorney, Agent, or Firm* — MeadWestvaco Intellectual Property Group

(57) ABSTRACT

A product dispensing system including a container that defines an internal volume and an access opening into the internal volume, at least one product received in the internal volume and a biasing assembly extendable into the internal volume to urge the product toward the access opening, wherein the container is engaged with the biasing assembly when the biasing assembly extends into the internal volume.

19 Claims, 10 Drawing Sheets

(56) References Cited

U.S. PATENT DOCUMENTS

| | | | | |
|---|---|---|---|---|
| 4,457,512 | A | 7/1984 | Stevenson | |
| 4,834,263 | A | 5/1989 | Becze | |
| 4,907,707 | A * | 3/1990 | Crum | 211/59.3 |
| 5,012,936 | A * | 5/1991 | Crum | 211/59.3 |
| 5,178,298 | A * | 1/1993 | Allina | 221/24 |
| 5,665,304 | A * | 9/1997 | Heinen et al. | 312/71 |
| 5,671,851 | A | 9/1997 | Johnson | |
| 5,855,283 | A * | 1/1999 | Johnson | 211/59.3 |
| 6,601,498 | B1 | 8/2003 | O'Brion | |
| 6,991,116 | B2 | 1/2006 | Johnson et al. | |
| 7,207,447 | B2 | 4/2007 | Medcalf et al. | |
| D588,386 | S | 3/2009 | Johnson et al. | |
| D595,074 | S | 6/2009 | Johnson et al. | |
| 7,614,543 | B1 | 11/2009 | Miller | |
| 7,690,518 | B2 | 4/2010 | Fincher et al. | |
| 7,690,519 | B2 | 4/2010 | Kahl | |
| 7,757,890 | B2 | 7/2010 | Alford et al. | |
| D621,644 | S | 8/2010 | Johnson | |
| 7,841,479 | B2 | 11/2010 | Budge et al. | |
| 7,913,860 | B2 | 3/2011 | Merl | |
| 7,918,353 | B1 | 4/2011 | Luberto | |
| 7,918,365 | B2 | 4/2011 | White et al. | |
| 7,992,747 | B2 | 8/2011 | Bauer | |
| 8,028,855 | B2 | 10/2011 | White et al. | |
| 8,038,017 | B2 * | 10/2011 | Close | 211/59.3 |
| 8,047,400 | B1 | 11/2011 | Luberto et al. | |
| 8,066,128 | B2 | 11/2011 | Crawbuck | |
| 8,448,792 | B2 * | 5/2013 | Gelardi et al. | 211/59.3 |
| 2001/0000643 | A1 * | 5/2001 | Roeker et al. | 312/61 |
| 2002/0148794 | A1 * | 10/2002 | Marihugh | 211/59.3 |
| 2003/0024889 | A1 | 2/2003 | Dumontet | |
| 2004/0065631 | A1 * | 4/2004 | Nagel | 211/59.3 |
| 2005/0072747 | A1 * | 4/2005 | Roslof et al. | 211/59.3 |
| 2005/0092644 | A1 | 5/2005 | Cafferatta | |
| 2005/0161413 | A1 * | 7/2005 | Close | 211/51 |
| 2005/0207877 | A1 | 9/2005 | Haverdink et al. | |
| 2005/0258113 | A1 * | 11/2005 | Close et al. | 211/59.3 |
| 2007/0068885 | A1 * | 3/2007 | Busto et al. | 211/59.3 |
| 2007/0194037 | A1 * | 8/2007 | Close | 221/100 |
| 2008/0245813 | A1 | 10/2008 | Johnson et al. | |
| 2009/0039040 | A1 | 2/2009 | Johnson et al. | |
| 2009/0212066 | A1 | 8/2009 | Bauer | |
| 2009/0266776 | A1 | 10/2009 | Johnson | |
| 2009/0308885 | A1 | 12/2009 | Sainato et al. | |
| 2010/0096401 | A1 | 4/2010 | Sainato et al. | |
| 2010/0107670 | A1 * | 5/2010 | Kottke et al. | 62/250 |
| 2010/0237093 | A1 * | 9/2010 | Lockwood et al. | 221/279 |
| 2011/0215061 | A1 | 9/2011 | Niederhuefner | |
| 2012/0080392 | A1 * | 4/2012 | Gelardi et al. | 211/59.3 |
| 2012/0118840 | A1 * | 5/2012 | Howley | 211/59.3 |
| 2013/0206786 | A1 * | 8/2013 | Diamond et al. | 221/24 |
| 2013/0240467 | A1 * | 9/2013 | Ciesick | 211/59.3 |

FOREIGN PATENT DOCUMENTS

| | | | |
|---|---|---|---|
| GB | 2291788 | A * | 2/1996 |
| GB | 2386116 | | 9/2003 |
| NL | 6508779 | | 1/1966 |
| WO | WO 9943241 | A2 * | 9/1999 |
| WO | 00/54632 | | 9/2000 |
| WO | WO 0054632 | A1 * | 9/2000 |

OTHER PUBLICATIONS

International Preliminary Report on Patentability, PCT/US2012/027363 (2013).

* cited by examiner

PRODUCT BIASING AND DISPENSING SYSTEM WITH SECURITY ENGAGEMENT

FIELD

This application relates to the dispensing of products and, more particularly, to the dispensing of products from packaging containers.

BACKGROUND

Products are typically shipped to retailers in bulk by enclosing multiple individual product units in a container such as a carton or box. For example, pharmaceuticals may be shipped to a retailer in a container housing multiple carton units, with each carton unit housing multiple units of pharmaceuticals (e.g., in blister-type packages). Then, a stock clerk typically removes the carton units from the container and stacks them on a display unit, such as a shelf, thereby making the products available to consumers.

The process of removing products from shipping containers and stacking the products on a shelf can be quite time consuming. Specifically, the traditional package-ship-unpack-display model requires a stock clerk to obtain a package from the supplier, open the package, remove all of the product units from the open package, and stack each of the product units on a display, such as a shelf. In the case of small, high volume products, such as pharmaceuticals, the amount of time required to neatly stock a display can become extensive, thereby significantly increasing a retailer's overall operating expenses.

As an alternative to the traditional package-ship-unpack-display model, products are being packaged in containers that also function as product dispensers. For example, packaging containers have been developed that include tear-away seals that, when removed, provide an opening into the container. Therefore, a store clerk is simply required to remove the tear-away seal to form the opening and then place the open container on the display. Consumers may then retrieve products from the container through the opening.

Unfortunately, as products are removed from the container/dispenser, products positioned a distance away from the opening in the container/dispenser may become difficult to retrieve. The difficulty may be particularly significant when the opening in the container/dispenser is relatively small and/or when the container/dispenser is relatively large or elongated. Therefore, various biasing assemblies have been developed, as described in greater detail in U.S. patent application Ser. No. 12/897,098 titled "Product Dispensing System with Biasing Assembly" filed on Oct. 4, 2010, the entire contents of which are incorporated herein by reference.

Furthermore, containers that also function as product dispensers raise concerns about theft. For example, thieves have been known to steal large quantities of product simply by taking an entire container/dispenser filled with product.

Accordingly, those skilled in the art continue with research and development efforts in the field of product packaging and dispensing.

SUMMARY

In one aspect, the disclosed product dispensing system may include a container that defines an internal volume and an access opening into the internal volume, at least one product received in the internal volume and a biasing assembly extendable into the internal volume to urge the product toward the access opening, wherein the container is engaged with the biasing assembly when the biasing assembly extends into the internal volume.

In another aspect, the disclosed product dispensing system may include an elongated rail having a front end and a rear end, a container positioned proximate the front end, the container defining an internal volume and an access opening into the internal volume, at least one product received in the internal volume, and a moveable member slidably engaged with the rail and biased into engagement with the product to urge the product toward the access opening, wherein the moveable member engages the container to inhibit separation of the container from the rail.

In yet another aspect, disclosed is a method for dispensing products. The method may include the steps of (1) providing a biasing assembly that includes an elongated rail having a front end and a rear end, a moveable member slidably engaged with the rail and a biasing element positioned to urge the moveable member toward the front end of the rail, (2) providing a container that defines an internal volume, a channel having a front end and a rear end, and a weakened separation area proximate the front end of the channel, the container housing at least one product in the internal volume, (3) positioning the container proximate the front end of the rail such that the moveable member extends through the channel into engagement with the product and (4) lifting the container from the biasing assembly when the moveable member is positioned over the weakened separation area.

Other aspects of the disclosed product biasing and dispensing system and method with security engagement will become apparent from the following description, the accompanying drawings and the appended claims.

DETAILED DESCRIPTION

Figure 1:
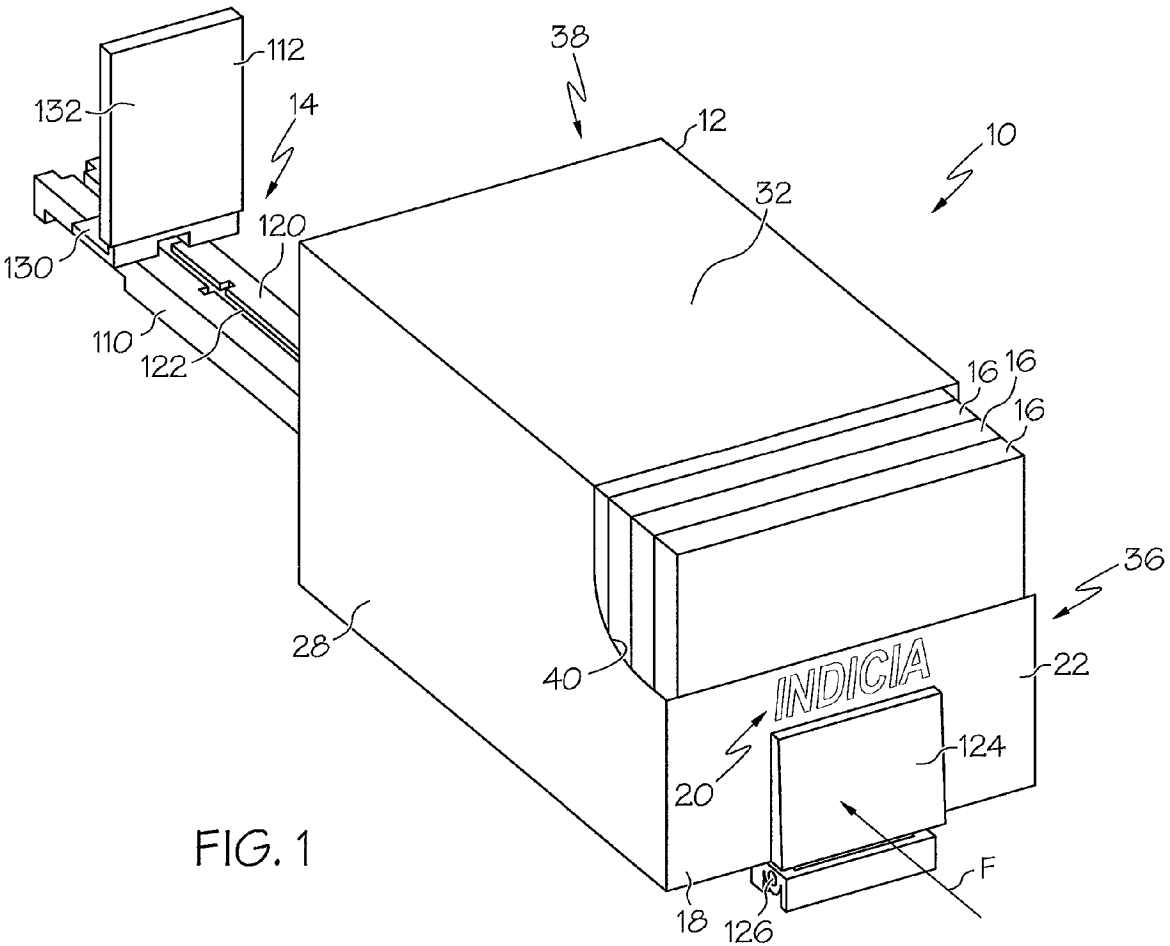
FIG. 1 is a front and side perspective view of one aspect of the disclosed product biasing and dispensing system with security engagement, shown with the biasing assembly in a disengaged configuration.
Figure 2:
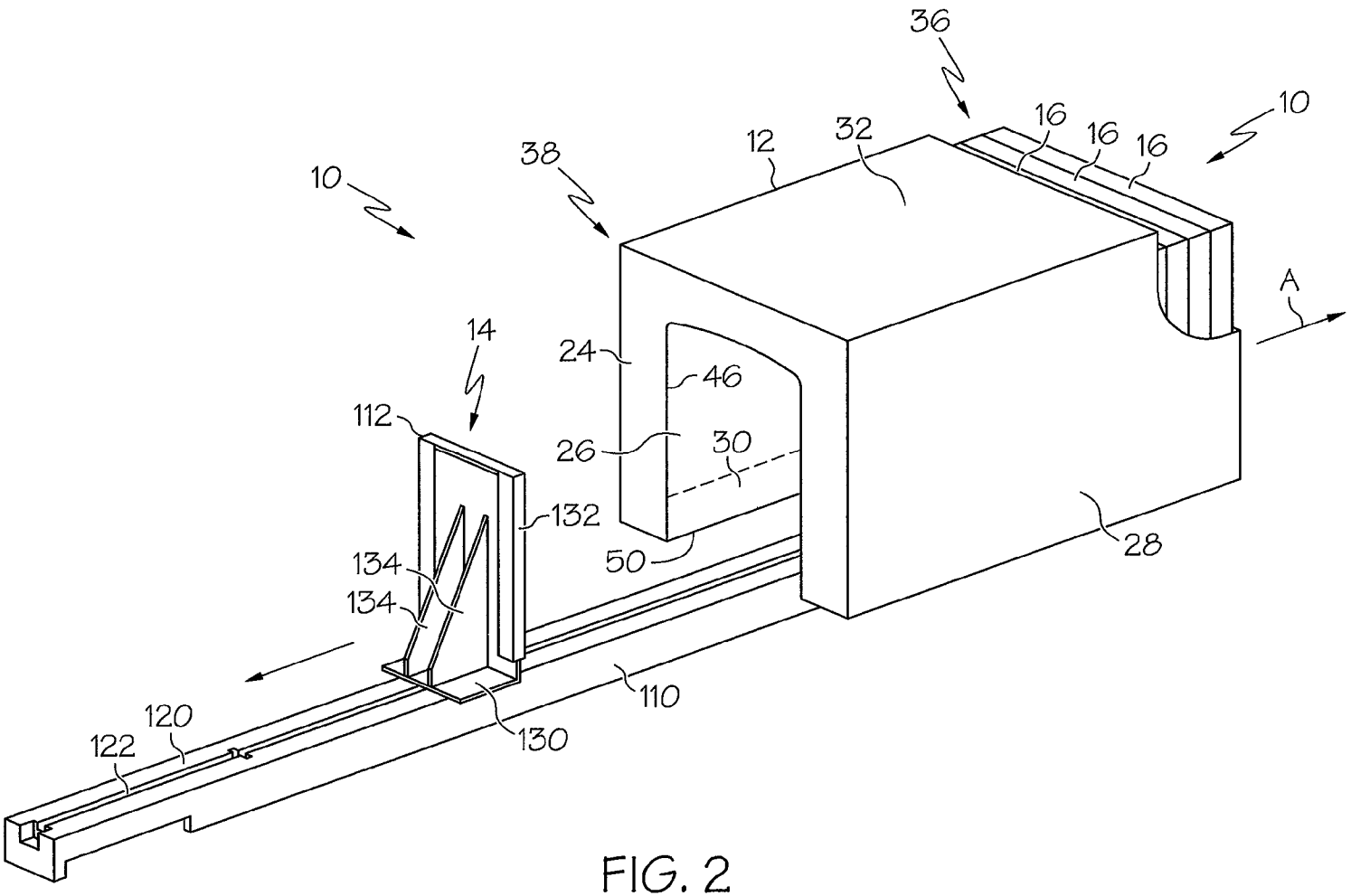
FIG. 2 is a rear and side perspective view of the product biasing and dispensing system of FIG. 1.

Referring to FIGS. 1 and 2, one aspect of the disclosed product biasing and dispensing system with security engagement, generally designated 10, may include a container 12 and a biasing assembly 14. The container 12 may house a plurality of products 16 and the biasing assembly 14 may extend into the container 12 to apply a biasing force to the products 16 to urge the products 16 relative to the container 12. An engagement between the container 12 and the biasing assembly 14 may inhibit separation of the container 12 from the biasing assembly 14 prior to the removal of at least some of the products 16 from the container 12.

The container 12 may be any container capable of housing products 16 and interacting with the biasing assembly 14. For example, the container 12 may be a paperboard carton or a corrugated box. Optionally, as shown in FIG. 1, at least one major surface 18 of the container 12 may be marked with indicia 20, such as printed text and/or graphics.

Figure 3:
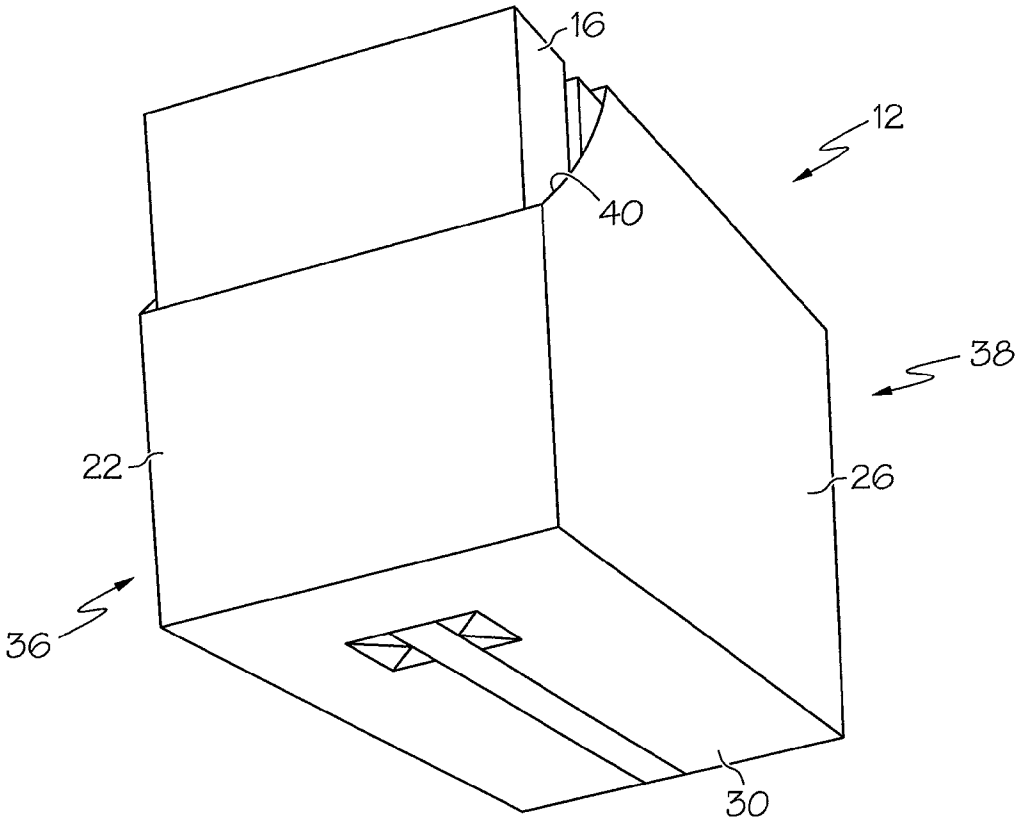
FIG. 3 is a front and bottom perspective view of the container of the product biasing and dispensing system of FIG. 1, shown in an open configuration.
Figure 4:
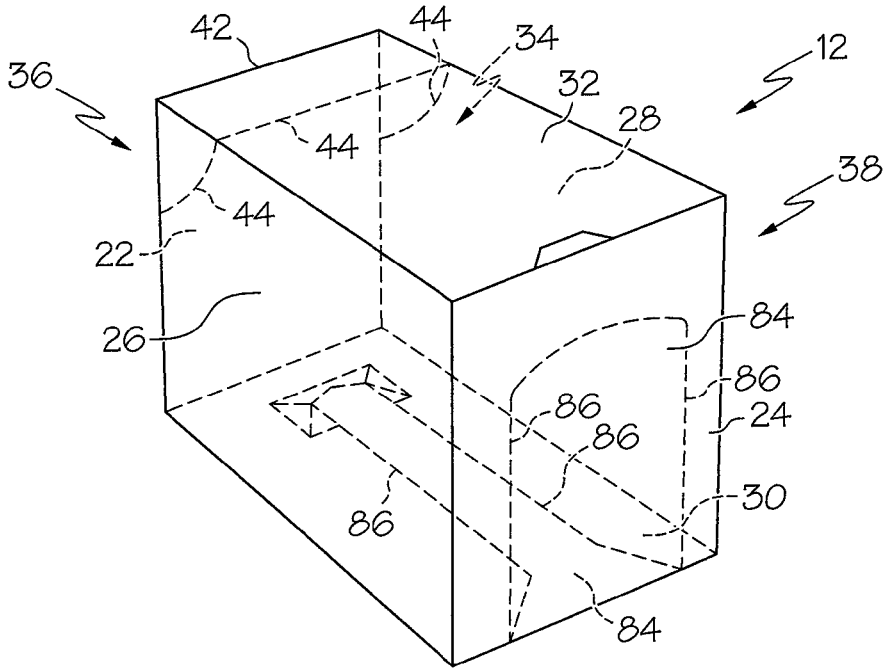
FIG. 4 is a rear perspective view of the container of FIG. 3, shown in an unopened configuration.
Figure 5:
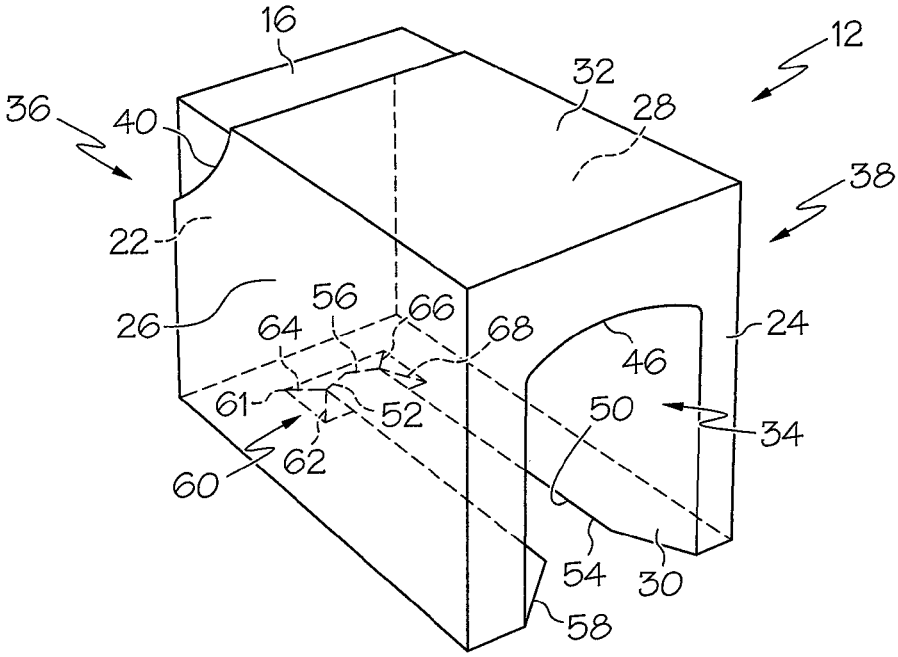
FIG. 5 is a rear perspective view of the container of FIG. 4, shown in an open configuration.

Referring to FIGS. 3-5, in one particular construction, the container 12 may be a generally rectilinear container having six walls 22, 24, 26, 28, 30, 32 that define an internal volume 34 for receiving the products 16. Opposed walls 22 and 24 may define the front and rear walls, respectively, of the container 12. Opposed walls 26 and 28 may define the first (e.g., right) and second (e.g., left) side walls, respectively, of the container 12. Opposed walls 30 and 32 may define the base and upper walls, respectively, of the container 12.

The front wall 22 may be positioned proximate (i.e., at or near) the front end 36 of the container 12 and the rear wall 24 may be positioned proximate the rear end 38 of the container 12. The front end 36 may be spaced from the rear end 38 along the longitudinal axis A (FIG. 2) of the container 12.

As shown in FIGS. 3 and 5, the front end 36 of the container 12 may define an access opening 40 into the internal volume 34. For example, the access opening 40 may be formed in the front 22, right side 26, left side 28 and upper 32 walls of the container 12. The access opening 40 may be sized and shaped to allow products 16 to pass therethrough. Therefore, the access opening 40 may provide consumers with access to the products 16 housed in the internal volume 34 proximate the front end 36 of the container 12.

In one particular implementation, the system 10 (FIGS. 1 and 2) may be positioned on a store shelf such that the access opening 40 is positioned proximate the front edge of the shelf.

Referring to FIG. 4, the container 12 may include a tear-away seal 42. In one particular construction, the tear-away seal 42 may be defined by pre-formed tear lines 44, such as perforations. Therefore, the opening 40 in the container 12 may be formed by separating the tear-away seal 42 from the container 12, such as by tearing the tear-away seal 42 along the pre-formed tear lines 44. The pre-formed tear lines 44 may have a tear strength that is sufficiently low to allow manual separation of the tear-away seal 42 from the container 12 along the pre-formed tear lines 44.

Referring to FIG. 5, the rear end 38 of the container 12 may define an engagement opening 46 into the internal volume 34. The engagement opening 46 may be sized and shaped to allow the moveable member 112 (discussed below) of the biasing assembly 14 to pass therethrough. For example, the engagement opening 46 may be formed in the rear wall 24 of the container 12. Optionally, the engagement opening 46 may extend into the base wall 30 of the container 12.

Still referring to FIG. 5, the base wall 30 of the container 12 may define a channel 50 extending therethrough. The channel 50 may extend through the base wall 30 along the longitudinal axis A (FIG. 2) of the container, and may include a front end 52 and a rear end 54. The front end 52 of the channel 50 may extend toward the front end 36 of the container 12, and may be tapered to a point at its distal most end 56. The rear end 54 of the channel 50 may extend to the engagement opening 46 in the rear wall 24, and may include a tapered region 58 at the transition between the engagement opening 46 and the channel 50.

Figure 6:
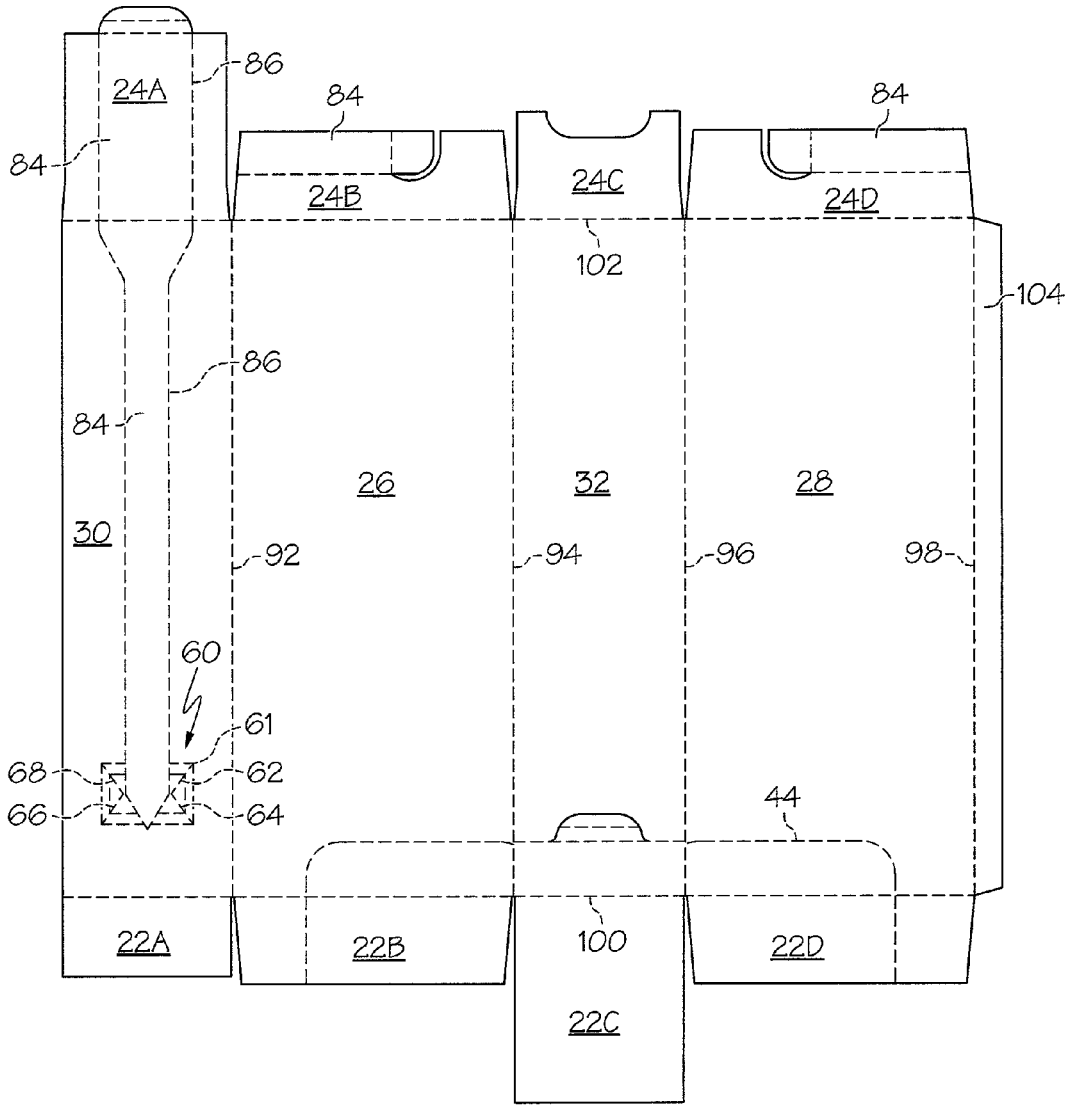
FIG. 6 is a top plan view of a container blank that may be used to form the container of FIG. 4.

As shown in FIGS. 5 and 6, the base wall 30 of the container 12 may further define a weakened separation area 60. The front end 52 of the channel 50 may extend proximate the weakened separation area 60.

The weakened separation area 60 may be encircled by a pre-formed pivot line 61, such as a crease or a score. The weakened separation area 60 may include pre-formed tear lines 62, 64, 66, 68. The pre-formed tear lines 62, 64, 66, 68 may radiate outward from the front end 52 of the channel 50 toward the pre-formed pivot line 61.

Figure 12:
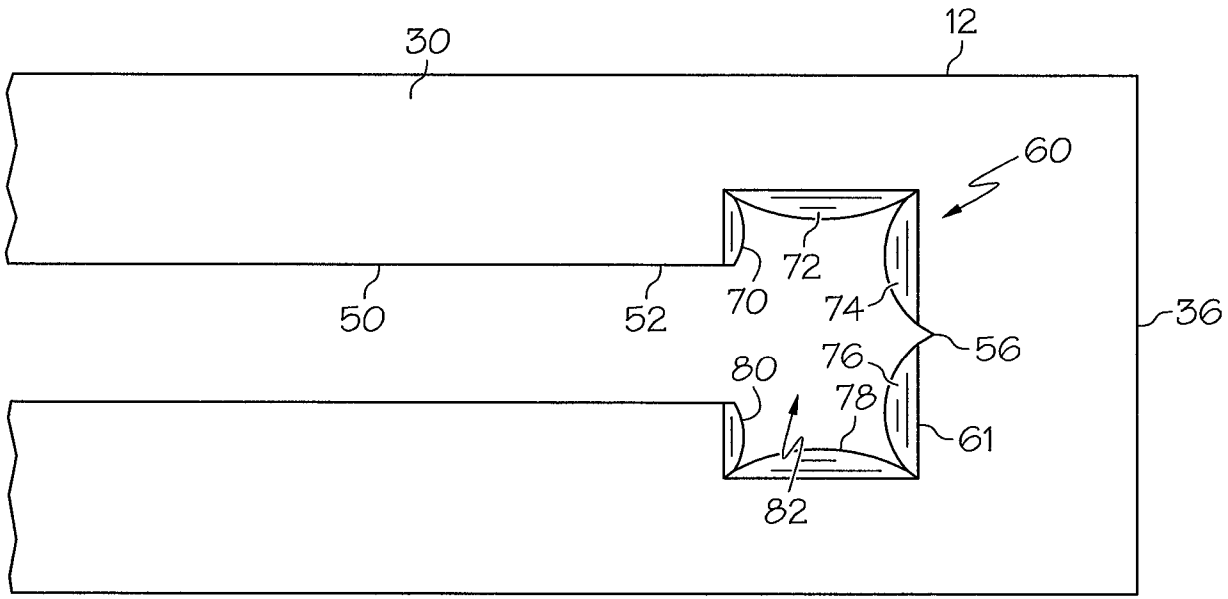
FIG. 12 is a top plan view, in section, of the container of the product biasing and dispensing system of FIG. 11, shown after the biasing assembly has been separated from the container.

As shown in FIG. 12, the pre-formed tear lines 62, 64, 66, 68 may be severed to form pivoting flaps 70, 72, 74, 76, 78, 80. The flaps 70, 72, 74, 76, 78, 80 may pivot about the pre-formed pivot line 61 relative to the base wall 30 to define a separation opening 82 in the weakened separation area 60 of the base wall 30.

Referring to FIGS. 4 and 6, the container 12 may include one or more tear-away panel 84 that may be separated from the container 12 to form the engagement opening 46 and the channel 50. In one particular construction, the tear-away panel 84 may be defined by pre-formed tear lines 86, such as perforations. Therefore, the engagement opening 46 and the channel 50 may be formed in the container 12 by separating the tear-away panel 84 from the container 12, such as by tearing the tear-away panel 84 along the pre-formed tear lines 86.

The container 12 may be formed from a paperboard container blank, such as the paperboard container blank 90 shown in FIG. 6. The container blank 90 may include a plurality of pre-formed fold lines 92, 94, 96, 98, 100, 102 that define the front wall 22 (comprised of front wall panels 22A, 22B, 22C, 22D), the rear wall 24, (comprised of rear wall panels 24A, 24B, 24C, 24D), the right side wall 26, the left side wall 28, the base wall 30, the upper wall 32 and a sealing flap 104.

The container 12 may be assembled by folding the container blank 90 along the longitudinal fold lines 92, 94, 96, 98 and connecting the sealing flap 104 to the base wall 30 to form the three-dimensional body of the container 12. Then, the front wall panels 22A, 22B, 22C, 22D may be assembled to form the front wall 22 of the container 12. Finally, the rear wall panels 24A, 24B, 24C, 24D may be assembled to form the rear wall 24 of the container 12.

While a specific paperboard container blank 90 is shown and described, those skilled in the art will appreciate that various techniques and materials may be used to form the container 12. Folded paperboard containers are only one specific and non-limiting example of the disclosed container 12.

The products 16 may be received in the internal volume 34 of the container 12, and may be longitudinally arranged in a row between the front and rear ends 36, 38 of the container 12. In one alternative expression, two or more rows of product 16 may be simultaneous dispensed from a single container 12. In another alternative expression, the products 16 may be arranged in the container 12 other than in rows, such as in a staggered (e.g., zig-zag) pattern or randomly. Those skilled in the art will appreciate that a staggered pattern may optimize the use of space in the container 12 when the products are generally cylindrical (e.g., cans or bottles).

Those skilled in the art will appreciate that a wide variety of products 16 may be packaged in, and dispensed from, the container 12 of the disclosed product biasing and dispensing system 10. As one example, the products 16 may be various foodstuffs packaged in boxes, cartons, pouches, cans or bottles. As another example, the products 16 may be various consumer goods, and may or may not be individually contained in a package, such as a box, carton, clamshell, pouch or the like. Other examples of products 16 suitable for being dispensed from the disclosed product biasing and dispensing system 10 are left to the skilled artisan.

Figure 7:
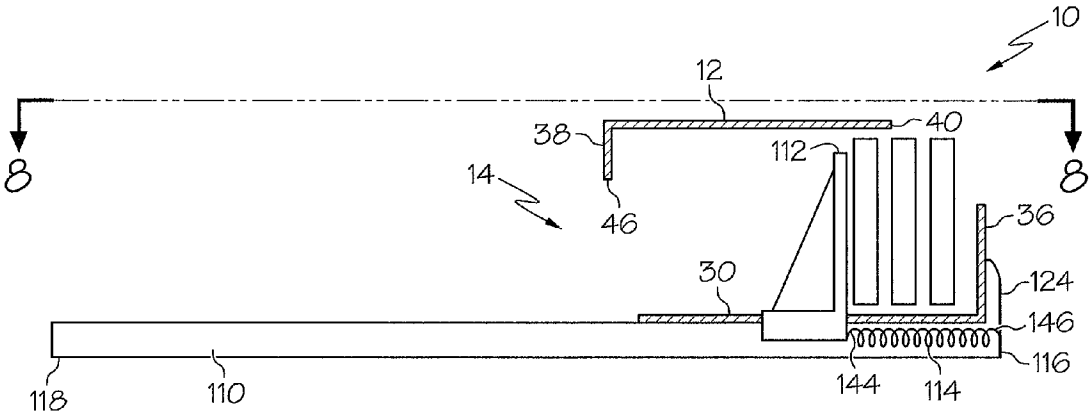
FIG. 7 is a side elevational view, in section, of the product biasing and dispensing system of FIG. 1, shown in an engaged configuration.

Referring to FIG. 7, the biasing assembly 14 may include a rail 110, a moveable member 112 and a biasing element 114. The moveable member 112 may be a sled or the like and may be slidably engaged with the rail 110. The biasing element 114 may urge the moveable member 112 through the engagement opening 46 and the channel 50 in the container 12 to urge the products 16 housed in the internal volume 34 of the container 12 toward the front end 36 of the container 12.

Figure 8:
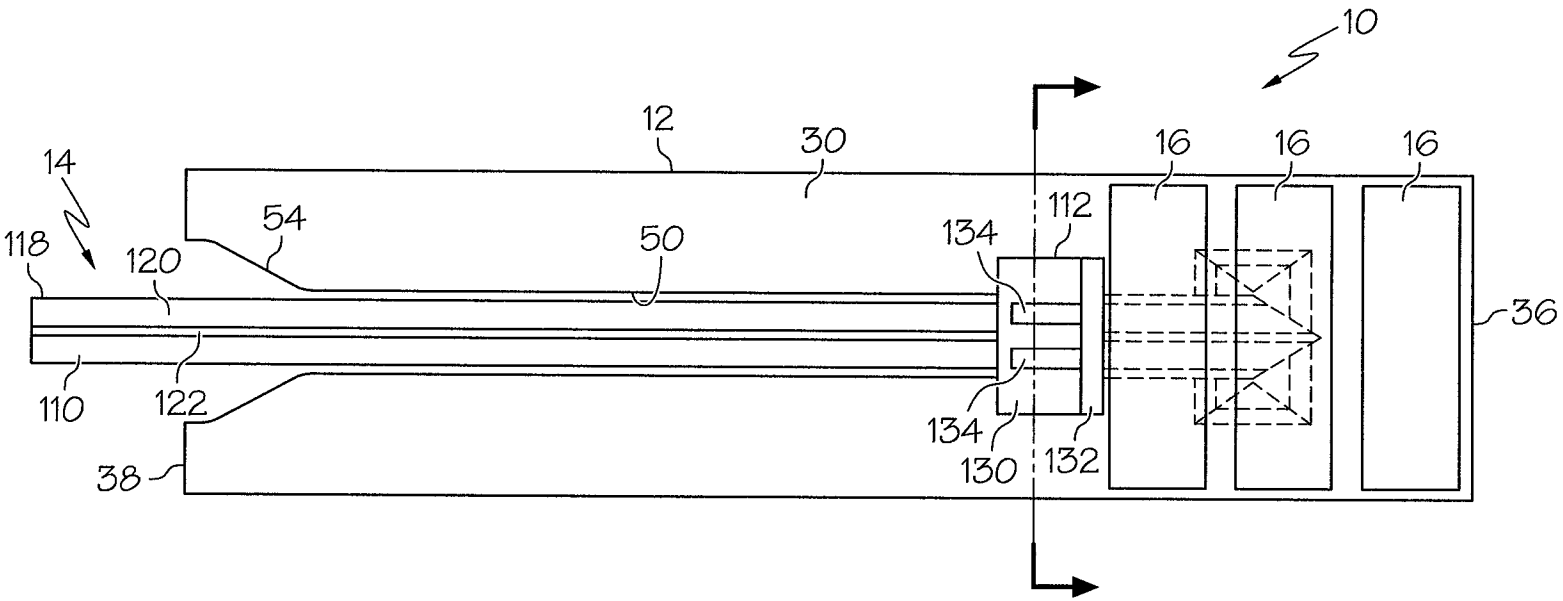
FIG. 8 is a top plan view, in section, of the product biasing and dispensing system of FIG. 7.

The rail 110 may be elongated, and may include a front end 116 and a rear end 118. As shown in FIGS. 1, 2 and 8, the rail 110 may define a sliding surface 120 and an elongated track 122 formed in the sliding surface 120. The elongated track 122 may extend from proximate the front end 116 of the rail 110 to proximate the rear end 118 of the rail 110. The container 12 may be positioned on the rail 110 proximate the front end 116 of the rail 110 such that the longitudinal axis A of the container 12 is generally aligned (e.g., parallel) with the elongated track 122.

Still referring to FIG. 7, a stop 124 may be positioned proximate the front end 116 of the rail 110 such that the front end 36 of the container 12 abuts the stop 124. Therefore, the stop 124 may function to prevent (or at least inhibit) longitudinal movement of the container 12 distally beyond the stop 124.

Optionally, as shown in FIG. 1, the stop 124 may be connected to the rail 110 at a pivot point 126. Therefore, the stop 124 may pivot from the forward-most configuration shown in FIG. 1 rearward to a collapsed configuration when a force (arrow F) is applied to the stop 124, such as when a container 12 is loaded onto the biasing assembly 14.

As best shown in FIGS. 1, 2 and 8, the moveable member 112 may include a base 130 and a face panel 132 connected to the base 130. The face panel 132 of the moveable member 112 may extend generally perpendicularly from the base 130. Optional struts 134 may extend from the face panel 132 to the base 130 to resist pivotal movement of the face panel 132 relative to the base 130.

The base 130 of the moveable member 112 may be slidably engaged with the rail 110 such that the moveable member 112 may move longitudinally along the sliding surface 120 of the rail 110 between the front end 116 and rear end 118 of the rail 110. Those skilled in the art will appreciate that various techniques may be used to effect a sliding engagement between the rail 110 and the moveable member 112, and that variation in the techniques used to effect such a sliding engagement will not result in a departure from the scope of the present disclosure.

Figure 9:
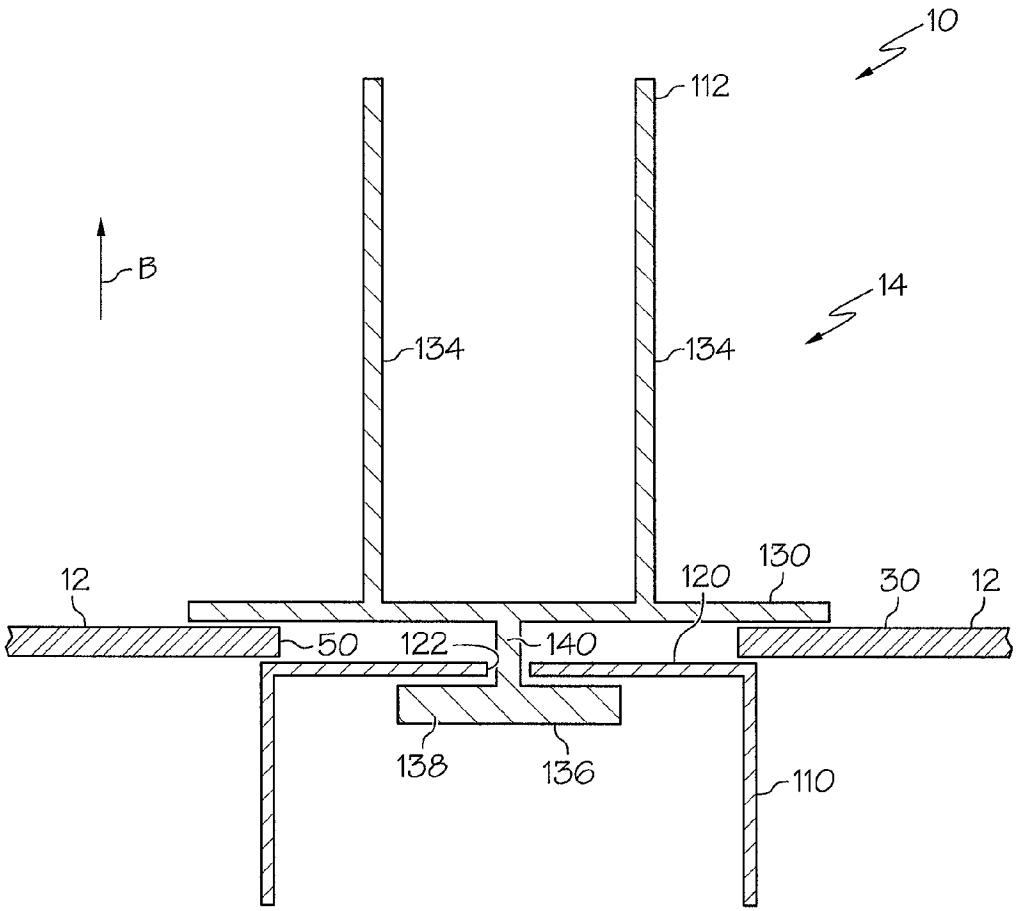
FIG. 9 is a front elevational view, in section, of the product biasing and dispensing system of FIG. 8.

As shown in FIG. 9, in one particular construction, the base 130 of the moveable member 112 may include a T-shaped member 136 connected thereto and engaged with the rail 110. The T-shaped member may include a cross member 138 and a tie member 140 connecting the cross member 138 to the base 130 of the moveable member 112. The tie member 140 may extend through the track 122 in the rail 110 such that a portion of the rail 110 (particularly a portion of the sliding surface 120) is positioned between the base 130 of the moveable member 112 and the cross member 138. Therefore, the moveable member 112 (particularly the tie member 140) may longitudinally move through the track 122 in the rail 110, but the cross member 138 may resist separation of the moveable member 112 from the rail 110.

Referring back to FIG. 7, the biasing element 114 may be connected to, or may otherwise act on, the moveable member 112 to urge the moveable member 114 toward the front end 116 of the rail 110. Those skilled in the art will appreciate that various biasing elements 114 may be used to urge the moveable member 112 toward the front end 116 of the rail 110, and that variation in the type of biasing element 114 used to effect such a bias will not result in a departure from the scope of the present disclosure.

In one particular implementation, the biasing element 114 may be a tension spring, and may include a first end 144 connected to the moveable member 112 and a second end 146 connected to the front end 116 of the rail 110. While a helical coil tension spring is shown, another example of a suitable tension spring is a rolled, tape measure-style extension spring.

In another implementation, the biasing element 114 may be a compression spring. For example, while not shown, the compression spring may be positioned between the rear end 118 of the rail 110 and the moveable member 112 to urge the moveable member 112 toward the front end 116 of the rail 110.

Referring to FIGS. 7-9, when the container 12 is mounted on the biasing assembly 14, the biasing element 114 urges the moveable member 112 through the opening 46 in the rear end 38 of the container 12, through the channel 50 in the base wall 30 of the container 12 and, ultimately, toward the front end 36 of the container 12. As the moveable member 112 moves toward the front end 36 of the container 12, the moveable member 112 may engage the products 16 housed in the container 12 and may urge the products 16 toward the opening 40 in the front end 36 of the container 12.

As best shown in FIGS. 8 and 9, as the moveable member 112 moves through the channel 50 in the base wall 30 of the container 12, a portion of the base wall 30 may be positioned directly below the base 130 of the moveable member 112. Therefore, the base 130 of the moveable member 112 may engage the base wall 30 of the container 12 when the container 12 is lifted upward (arrow B in FIG. 9), thereby inhibiting separation of the container 12 from the biasing assembly 14.

Figure 10:
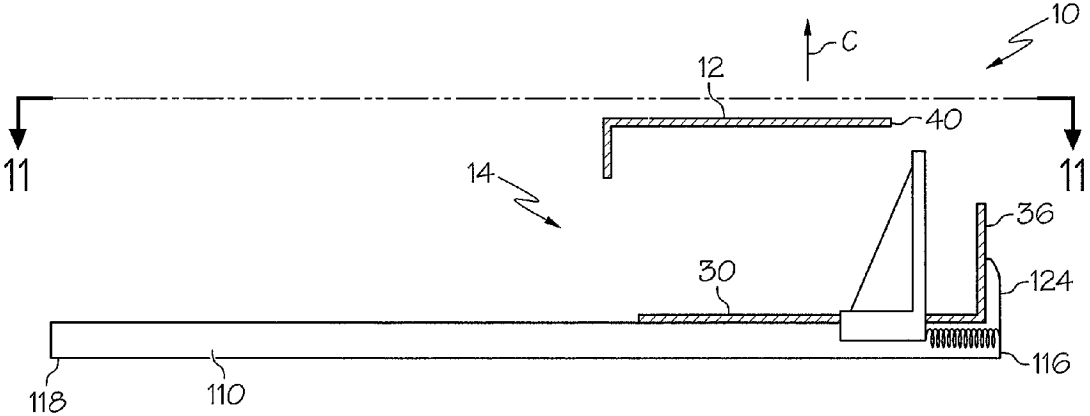
FIG. 10 is a side elevational view, in section, of the product biasing and dispensing system of FIG. 1, shown in a depleted configuration.
Figure 11:
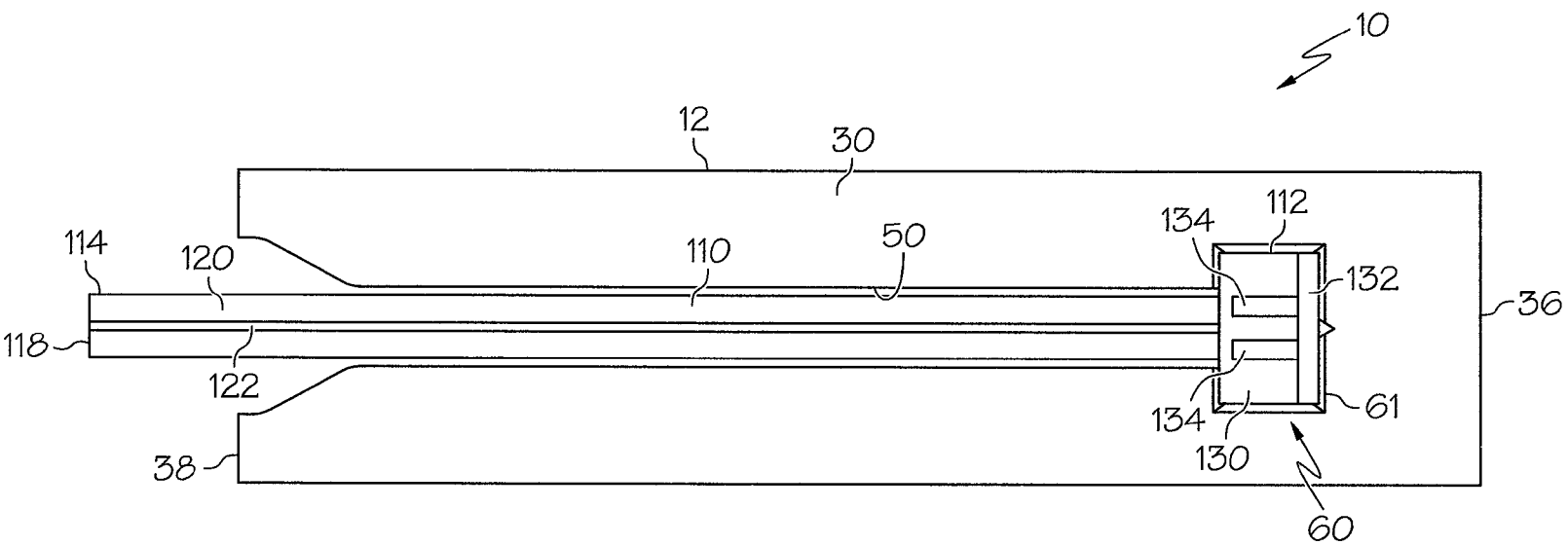
FIG. 11 is a top plan view, in section, of the product biasing and dispensing system of FIG. 10.

As shown in FIGS. 10 and 11, the moveable member 112 may continue to move forward as products 16 are removed from the container 12 by way of the access opening 40. Eventually, the moveable member 112 may be positioned over the weakened separation area 60 in the base wall 30 of the container 12.

As best shown in FIG. 11, with the moveable member 112 positioned over the weakened separation area 60, the container 12 may be separated from the biasing assembly 14 by lifting the container 12 upward from the biasing assembly 14 in the direction shown by arrow C (FIG. 10). As the container 12 is lifted from the biasing assembly 14, the force of the moveable member 112 acting on the weakened separation area 60 may sever the pre-formed tear lines 62 to form the flaps 70, 72, 74, 76, 78, 80 and, ultimately, the separation opening 82, as shown in FIG. 12. The moveable member 112 may pass through the separation opening 82 to separate the container 12 from the biasing assembly 14.

At this point, those skilled in the art will appreciate that the position of the weakened separation area 60 may determine the point at which the container 12 may be separated from the biasing assembly 14. While FIGS. 10 and 11 show the moveable member 112 positioned over the weakened separation area 60 only after the container 12 is fully depleted of product 16, the weakened separation area 60 may be at various alternative locations without departing from the scope of the present disclosure. For example, the weakened separation area 60 may be located such that the moveable member 112 may be positioned over the weakened separation area 60 when one (or two or three) product 16 remains in the container 12.

Accordingly, the disclosed product biasing and dispensing system 10 may include a biasing assembly 14 that urges products 16 toward the access opening 40 in a container 12, while simultaneously inhibiting separation of the container 12 from the biasing assembly 14. Separation of the container 12 from the biasing assembly 14 may be facilitated when the moveable member 112 of the biasing assembly 14 is positioned over a weakened separation area 60 in the container 12. The position on the weakened separation area 60 may dictate the point at which the container 12 may be separated from the biasing assembly 14.

Although various aspects of the disclosed product biasing and dispensing system with security engagement have been shown and described, modifications may occur to those skilled in the art upon reading the specification. The present application includes such modifications and is limited only by the scope of the claims.

What is claimed is:

1. A product dispensing system comprising:

a container that defines an internal volume and an access opening into said internal volume;

at least one product received in said internal volume; and a biasing assembly comprising a moveable member and a rail, said moveable member being slidably engaged with said rail and moveable into said internal volume to urge said product toward said access opening, wherein a portion of said container is positioned between said moveable member and said rail when said moveable member is positioned in said internal volume.

2. The product dispensing system of claim 1 wherein said container comprises paperboard.

3. The product dispensing system of claim 1 wherein said container comprises a plurality of walls, at least one wall of said plurality defining a channel, and wherein said moveable member is moveable through said channel into engagement with said product.

4. The product dispensing system of claim 1 wherein said container comprises a front end and a rear end, and wherein said access opening is formed proximate said front end.

5. The product dispensing system of claim 4 wherein said container further defines a second opening proximate said rear end, and wherein said moveable member is moveable through said second opening into said internal volume.

6. The product dispensing system of claim 4 wherein said container defines a channel extending between said front end and said rear end, said channel having a front end and a rear end.

7. The product dispensing system of claim 6 wherein said container defines a weakened separation area proximate said front end of said channel.

8. The product dispensing system of claim 7 wherein said weakened separation area comprises a pre-formed pivot line and a pre-formed tear line, said pre-formed tear line extending from said front end of said channel toward said pre-formed pivot line.

9. The product dispensing system of claim 8 wherein said weakened separation area comprises at least two flaps when said pre-formed tear line is severed, said flaps being pivotable about said pre-formed pivot line to form a separation opening in said container, said separation opening being sized to allow said moveable member to pass therethrough.

10. The product dispensing system of claim 1 wherein said portion of said container is positioned between a base of said moveable member and a top surface of said rail to engage said container with said biasing assembly and inhibit separation of said container from said biasing assembly in any direction not parallel to a longitudinal axis of said container.

11. The product dispensing system of claim 1 wherein said biasing assembly further comprises a biasing element positioned to bias said moveable member relative to said rail.

12. A method for dispensing products comprising the steps of:

providing a biasing assembly comprising:

an elongated rail having a front end and a rear end;

a moveable member slidably engaged with said rail; and a biasing element positioned to urge said moveable member toward said front end of said rail;

providing a container that defines an internal volume, a channel having a front end and a rear end, and a weakened separation area proximate said front end of said channel, said container housing at least one product in said internal volume;

positioning said container proximate said front end of said rail such that said moveable member extends through said channel into engagement with said product;

positioning a portion of said container between said rail and said moveable member to engage said container with said biasing assembly and inhibit separation of said container from said biasing assembly in any direction not parallel to a longitudinal axis of said container; and lifting said container from said biasing assembly when said moveable member is positioned over said weakened separation area.

13. A product dispensing system comprising:

an elongated rail having a front end, a rear end, and a top surface;

a container positioned proximate said front end, said container defining an internal volume and an access opening into said internal volume:

at least one product received in said internal volume; and a moveable member having a base, said moveable member being slidably engaged with said rail and biased into engagement with said product to urge said product toward said access opening, wherein a portion of said container is positioned between said base of said moveable member and said top surface of said rail to inhibit separation of said container from said rail in any direction not parallel to a longitudinal axis of said container.

14. The product dispensing system of claim 13 wherein said container comprises paperboard.

15. The product dispensing system of claim 13 wherein said container defines a channel having a first width, and wherein said moveable member is moveable through said channel and has a second width, said second width being greater than said first width.

16. The product dispensing system of claim 13 wherein said container defines a channel extending therethrough, said channel having a front end and a rear end.

17. The product dispensing system of claim 16 wherein said container further defines a weakened separation area proximate said front end of said channel.

18. The product dispensing system of claim 17 wherein said weakened separation area comprises a pre-formed pivot line and a pre-formed tear line, said pre-formed tear line extending from said front end of said channel toward said pre-formed pivot line.

19. The product dispensing system of claim 18 wherein said weakened separation area comprises at least two flaps when said pre-formed tear line is severed, said flaps being pivotable about said pre-formed pivot line to form a separation opening in said container, said separation opening being sized to allow said moveable member to pass therethrough.

* * * * *